United States Patent [19]

McMichael

[11] Patent Number: 4,888,961

[45] Date of Patent: Dec. 26, 1989

[54] COLD PLATE APPARATUS

[75] Inventor: Dannie L. McMichael, San Antonio, Tex.

[73] Assignee: Lancer Corporation, San Antonio, Tex.

[21] Appl. No.: 217,170

[22] Filed: Jul. 11, 1988

[51] Int. Cl.[4] ..... B67D 5/62

[52] U.S. Cl. ..... 62/398; 62/399; 62/464

[58] Field of Search ..... 62/400, 459, 398, 399, 62/464, 396, 390

[56] References Cited

U.S. PATENT DOCUMENTS 1,782,720 11/1930 Franklin ..... 62/398 X
2,871,675 2/1959 Cornelius ..... 62/398 X
4,291,546 9/1981 Rodth ..... 62/398
4,617,807 10/1986 Pritchett et al. ..... 62/399
4,651,538 3/1987 Brell et al. ..... 62/464 X

*Primary Examiner*—Lloyd L. King
*Attorney, Agent, or Firm*—Cox & Smith Incorporated

[57] ABSTRACT

A cold plate apparatus for use as a part of a beverage dispensing machine with an ice storage container. The apparatus is designed to be placed in the bottom of the ice storage container where ice may reside on the top surface of the apparatus. The apparatus comprises a block of aluminum through the interior of which run coils of tubing for carrying beverage liquids and having appropriate inlets and outlets. The apparatus provides means for optimizing the heat transferred from the beverage liquids to the ice. Means area also provided which minimize the time any accumulated layer of water due to the melting of ice resides on top of the apparatus.

4 Claims, 4 Drawing Sheets

COLD PLATE APPARATUS

BACKGROUND OF THE INVENTION

The present invention relates to an improved cooling apparatus of the cold plate type. Cold plates are a very old apparatus whereby melting ice is used to cool liquids circulated through tubing in thermal contact with the ice. For the particular application of cooling and dispensing beverages, a typical design would be to have coils of tubing carrying carbonated water, plain water, and beverage syrup running through an aluminum block. The aluminum block is what is referred to as a cold plate and is located at the bottom of an ice storage container. The coils of water and syrup are routed to appropriate mixing valves where the beverage is dispensed. The ice storage container thus serves the dual purpose of storing ice to dispense with the beverage and containing ice which absorbs heat from the cold plate.

The physical principle upon which a cold plate operates is simply that of using the melting ice as a heat sink which absorbs heat from the water and syrup as they flow through the cold plate. That is, heat flows from the water and syrup to the top of the cold plate upon which rests a quantity of ice. Rather than raising the temperature, the transferred heat effects a phase change of the ice from solid to liquid. The heat is, thus, absorbed as latent heat rather than raising the temperature of the heat sink. In this way, the heat capacity of the heat sink is greatly increased over what it would be if, for example, liquid water cooled to a freezing temperature were used as a heat sink.

As heat is transferred to the ice and melting occurs, however, a quantity of water is produced in the ice storage container above the cold plate. This water tends to inhibit the direct transfer of heat to the ice where the heat can be absorbed as the latent heat of melting. That is, the heat must first raise the temperature of the water slightly before the heat can be transferred to the ice. The resulting lower temperature differential retards the further flow of heat. Any water between the ice and the surface of the cold plate thus acts as an insulator. It is an object of the present invention to provide a means for minimizing the interposition of water between the ice and beverage coils in a cold plate apparatus.

Another problem associated with accumulated water above the cold plate is the occurrence of "bridging" when a portion of the ice melts, liquid water accumulates between the ice and the cold plate. If the liquid water is not immediately removed, the layer of liquid tends to enlarge by the addition of more melted ice until hydrostatic pressure forces the liquid toward a drain. After the liquid is drained, however, there is left a gap between the ice and the cold plate where the ice "bridges" over the area vacated by the liquid water. Since no ice is contacting the cold plate over this area, the cooling efficiency of the cold plate is severely diminished. U.S. Pat. No. 4,617,807 discloses a cold plate apparatus designed to overcome this problem by incorporating involute beverage coils. Since most of the heat transfer, and thus melting of ice, occurs over the area of the cold plate nearest the inlets of the beverage coils where the beverage is warmest, the '807 apparatus uses involute coils to provide for more uniform heat transfer and less accumulated water over any one area of the cold plate. This method of dealing with bridging problems, however, compromises the efficiency of the cold plate. The total heat transfer from beverage to ice is maximized by separating the warmer beverage from the colder beverage by as much distance as possible as the beverage flows through the coils within the cold plate. It is a further object of the present invention to provide a means for preventing accumulations of water which would cause bridging of ice but without compromising the cooling efficiency of the apparatus.

Another factor influencing the efficiency of a cold plate apparatus is the surface area of the beverage coils exposed to the cooling surface of the cold plate. It is a further object of the present invention to maximize the surface area of the beverage coils exposed to the cold plate.

A still further object of the present invention is to configure the beverage coils so that the inlet and outlet coil fittings are easily accessible during installation and repair.

SUMMARY OF THE INVENTION

The present invention is a cold plate designed to be installed in an ice storage container and used with a beverage dispensing apparatus. The cold plate is designed to operate with a quantity of ice residing on the top surface of the cold plate. The cold plate is designed to minimize the film of liquid water existing between the top surface of the cold plate and solid ice. A drain is located on the top surface to drain away liquid water as it accumulates. The drain is located near the inlets of the beverage liquids in order to minimize the time any accumulated liquid water resides on the cooling surface of the cold plate. Since the beverage liquids inlets, most of the melting of ice will occur over that region of the top surface of the cold plate nearest the beverage inlets. Additionally, the cooling surface of the cold plate slopes toward the drain enabling gravity to cause faster draining of an accumulated film of liquid water in order to minimize the possibility of bridging, as discussed above.

The coils of tubing carrying the beverage liquids through the cold plate traverse the rectangular shaped cold plate along the diagonal of the rectangle. This maximizes the length of the coiled tubing which passes through the cold plate and, therefore, the surface area of tubing exposed to the cooling surfaces of cold plate. Orienting the tubing along the diagonal also separates the warmer beverage liquids from the cooler beverage liquids by a greater distance resulting in increased cooling of the beverage liquids.

Also, the inlets and the outlets of the beverage coils are located on opposite sides of the cold plate. This enables the inlet and outlet fittings to be spaced farther apart which allows easier installation and servicing of the cold plate.

Finally, the coils carrying the beverage liquids are arranged within the cold plate so that the coils having the highest throughputs are closest to the top surface which is in contact with ice. In a typical beverage dispensing application, the beverage coils carrying carbonated water experience the highest throughput.

These and other objects, features and advantages of the present invention will become evident in light of the following detailed description, viewed in conjunction with the referenced drawings. The foregoing and following description of the present invention is for exemplary purposes only. The true spirit and scope of the invention is set forth in the appended claims.

DETAILED DESCRIPTION OF THE PREFERRED EMBODIMENT

Figure 1:
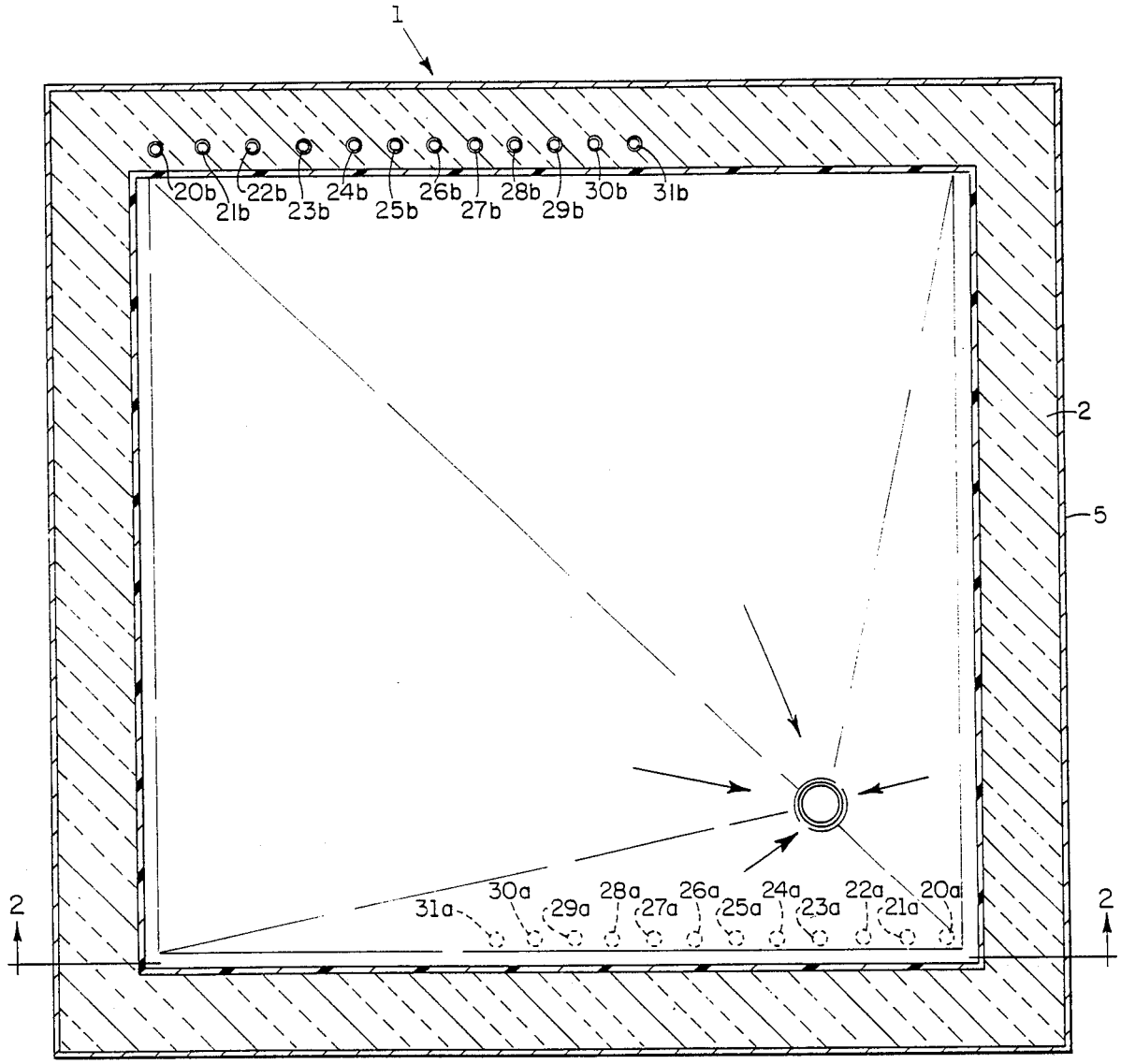
FIG. 1 is a top view of the cold plate apparatus showing a cross-section taken at the level of the line labeled 1—1 in FIG. 2.
Figure 2:
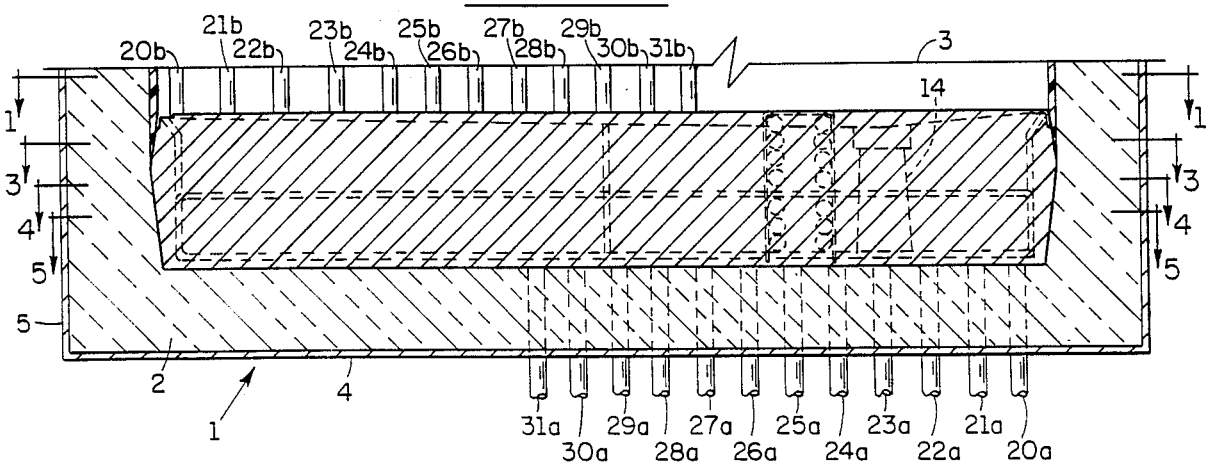
FIG. 2 is an end-view of a cross-section along the line labeled 2—2 in FIG. 1.

Referring to FIG. 1, there is shown a view from the above of the preferred embodiment of the present invention. Cold plate 1 comprises a solid aluminum block 2. Aluminum block 2 has a top 3, a bottom 4, and four sides 5. As shown in FIG. 1 and FIG. 2, the top 3 and bottom 4 of aluminum block 2 are of generally square shape while each of the four sides 5 is of generally rectangular shape. The top 3 of aluminum block 2 is slightly recessed around the edges to form cooling surface 12. When the apparatus is in operation and installed within an ice storage container, the ice resides upon cooling surface 12.

As shown in FIG. 1 and FIG. 2, also within aluminum block 2 is drain 14. Drain 14 is a cylindrical conduit formed when aluminum block 2 is cast. Cooling surface 12 is constructed to slope toward drain 14 at all points as depicted by the arrows in FIG. 1. By this means, gravity is used to continuously drain from cooling surface 12 any accumulated layer of water. Drain 14 serves to channel the water to any convenient drainage pipe or container.

Beverage liquid coils 20 through 31 are coils of stainless steel tubing which are immersed in aluminum block 2 at the time of casting. Coils 20 through 31 are arranged within aluminum block 2 such that no two coils are in contact with each other. Rather, each of coils 20 through 31 are completely surrounded by aluminum. As shown in FIG. 1 and FIG. 2 the respective inlets, 20*a* through 31*a*, and outlets, 20*b* through 31*b*, for coils 20 through 31 are located on opposite sides of cold plate 1. This allows the inlets and outlets to be spaced farther apart which facilitates the attachment and removal of fittings when the apparatus is installed or serviced.

When the apparatus is installed, cold plate 1 is placed at the bottom of an ice storage container having a drain connection which connects to drain 14. Inlets 20*a* through 31*a* are connected with conventional fittings to beverage sources. Outlets 20b through 31b are connected with conventional fittings to pieces of tubing which route the beverage liquids to appropriate mixing valves where the beverages are finally dispensed. In this preferred embodiment, coils 20 and 21 carry carbonated water, coil 22 carries plain water, and coils 23 through 31 carry the different beverage syrups used to flavor the beverage.

Figure 3:
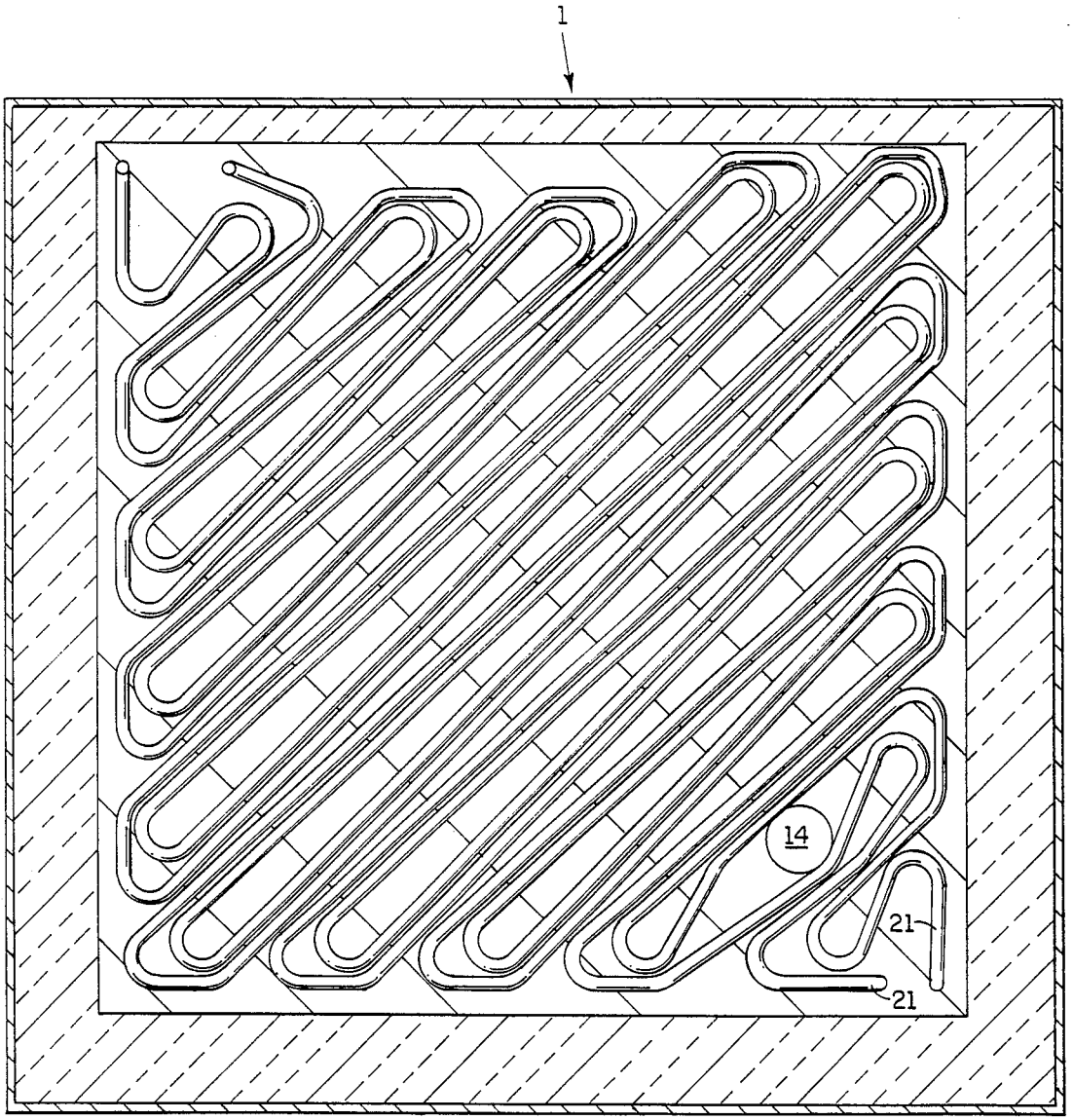
FIG. 3 is a top view of a cross-section taken at the level of the line labeled 3—3 in FIG. 2.

As shown in FIG. 2, the coils are arranged within aluminum block 2 such that carbonated water coils 20 and 21 are closest to cooling surface 12. Plain water coil 22 lies just below carbonated water coils 20 and 21 while syrup coils 3 through 31 lie in layers further below. This configuration places those beverage coils having the highest throughput nearest the cooling surface 12 where heat transfer will be maximal. Since a single dispenses drink will contain mostly water and some syrup, the operation of the apparatus is optimized by transferring relatively more heat from the water than from the syrup Referring to FIG. 3, there is shown one of carbonated water coils 21 as it courses through the interior of aluminum block 2. The arrangement of carbonated water coil 20 is identical but located at a layer just above. At a point slightly beyond where inlet 21 enters aluminum block 2, coil 21 bifurcates into two coils as shown in FIG. 3. The pair of coils 21 run parallel to one another as the pair traverses the diagonal of aluminum block 2. Coils 21 also run back and forth along the other diagonal to form the coiled arrangement which maximizes the length of tubing in contact with aluminum block 2. By placing the inlet and outlet in opposite corners of aluminum block 2, the distance between the inlet and outlet is maximized. The effect of this arrangement is to separate the points where the liquid is warmest and coldest by as great a distance as possible in order to maximize heat transfer.

Figure 4:
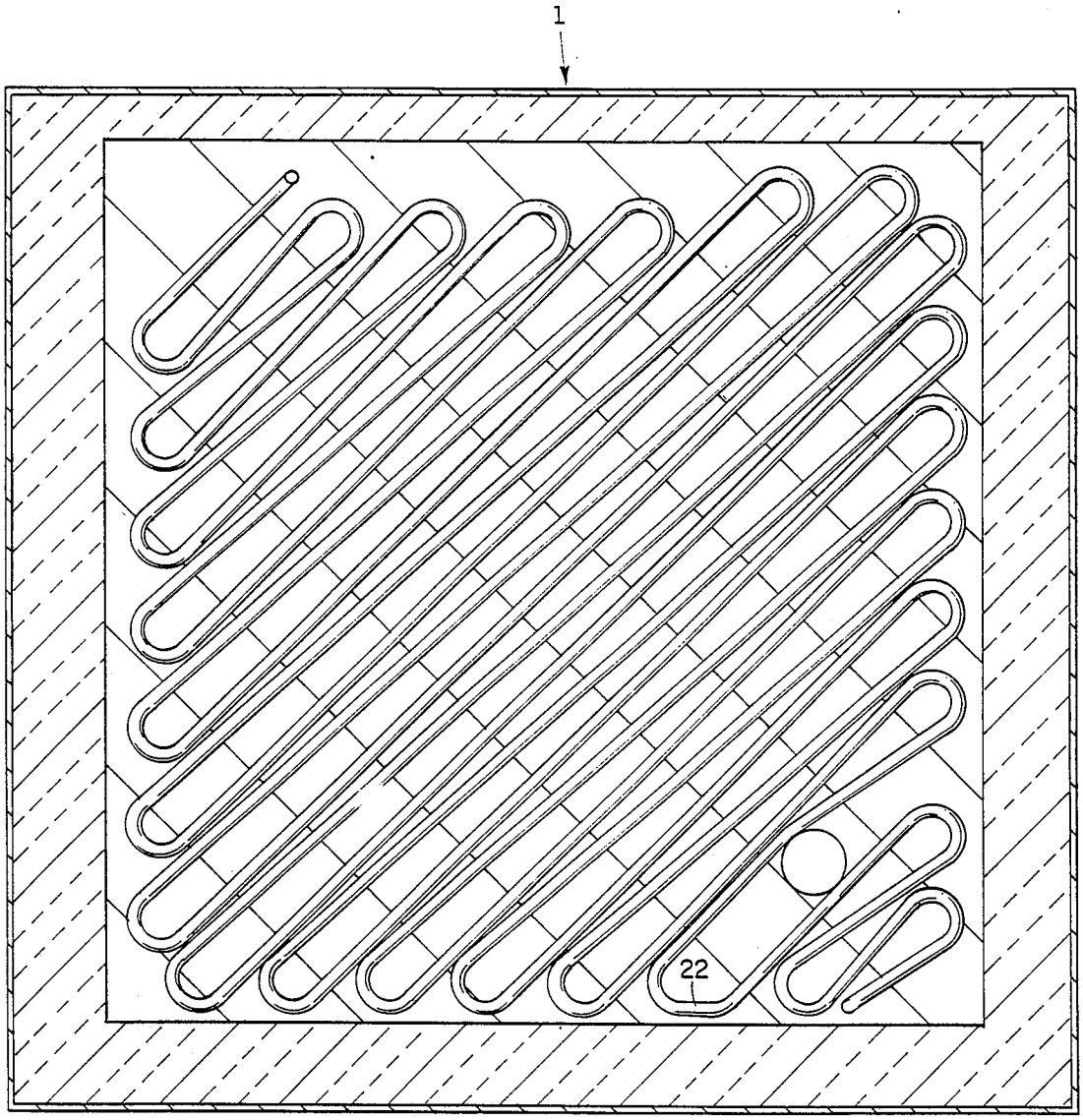
FIG. 4 is a top view of a cross-section taken at the level of the line labeled 4—4 in FIG. 2.

Referring to FIG. 4, there is shown plain water coil 22 as it courses through interior of aluminum block 2 similarly to carbonated water coil 21. Plain water coil 22 in this preferred embodiment, however, does not bifurcate into two portions as do carbonated water coils 20 and 21. Otherwise, the configuration of plain water coil 22 is identical to the configuration of carbonated water coils 20 and 21 described above.

Figure 5:
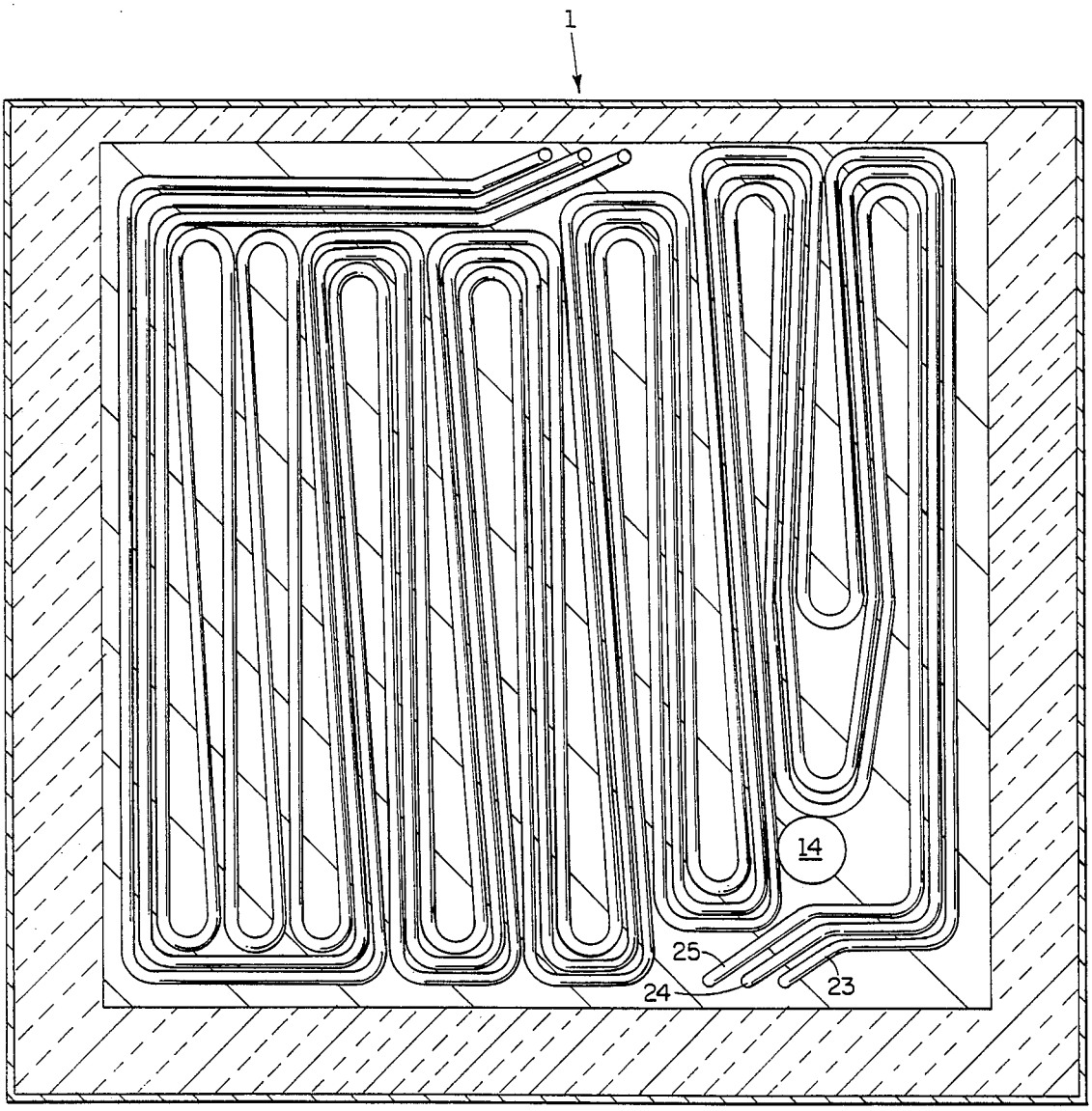
FIG. 5 is a top view of a cross-section taken at the level of the line labeled 5—5 in FIG. 2.

Referring to FIG. 5, there is shown three of beverage syrup coils 23, 24 and 25 as they run through the interior of aluminum block 2 at a level just below carbonated water coils 20 and 21 and plain water coil 22. Beverage syrup coils 26, 27, and 28 are configured identically in a layer just below, as are beverage coils 29, 30 and 31 in a layer still further below. In this preferred embodiment, beverage syrup coils 23, 24 and 25 do not course along the diagonal as do the plain water and carbonated water coils described above. Because of the less throughput through the syrup coils, there is less need to optimize the heat transfer by separating the points where the liquid is warmest and coldest by the greatest Possible distance. In an alternative embodiment, however, the syrup coil could be configured identically to the water coils.

As shown in FIG. 5, syrup coils 23, 24 and 25 travel form one side of aluminum block 2 to the other while coursing back and forth perpendicularly to form the coiled configuration. Syrup coils 23, 24 and 25 run parallel to each other to form a nested arrangement within aluminum block 2.

Referring now to FIG. 1, drain 14 is shown located near the corner of aluminum block 2 where the beverage liquid coils connect to their respective inlets. Since the beverage liquids will be at their warmest temperature just as they leave the inlets and enter the beverage liquid coils, the area of cooling surface 12 above this region will experience the greatest heat flux as heat flows from the beverage liquids to the ice residing on top of cooling surface 12. This means that most of the water from melting ice will be produced above this region of cooling surface 12. In order to minimize the time for which any accumulated water resides on cooling surface 12, drain 14 is placed in the corner as shown in FIG. 1, which is directly above the point where the beverage liquids are warmest.

Although the invention has been described in conjunction with the foregoing specific embodiment, many alternatives, variations and modifications are apparent to those of ordinary skill in the art. Those alternatives, variations and modifications are intended to fall within the spirit and scope of the appended claims.

I claim:

1. A cold plate for cooling liquids, comprising:

a block constructed of thermally conductive material such as aluminum and having a top surface upon which a quantity of ice can reside;

a plurality of beverage liquid coils formed of tubing, each coil having an inlet and an outlet, said plurality of coils coursing through the interior of said thermally conductive block in parallel fashion with the inlets and outlets of said plurality of coils located on opposite sides of said block for maximizing the thermal gradient existing between said coils and ice residing on the top surface of said block; and a drain hole on the top surface of said block and located generally near the inlets of said plurality of coils for draining any accumulated water on the top surface.

2. The cold plate of claim 1 wherein the top surface of said block is sloped toward said drain hole.

3. The cold plate of claim 2 wherein said plurality of coils course in serpentine fashion from corner of said block to the opposite corner, said drain hole located in the corner nearest the inlets of said plurality of coils.

4. The cold plate of claim 3 wherein said plurality of coils are divided into groups stacked vertically within the interior of said block.

* * * * *